United States Patent [19]

Ooms et al.

[11] 4,262,469

[45] Apr. 21, 1981

[54] APPARATUS FOR CLOSING BOXES

[76] Inventors: Hans Ooms, Witte de Withstraat 13, Noordwijk; Joseph J. M. Smidt, Const. Huygenslann 51, Leiden, both of Netherlands

[21] Appl. No.: 45,927

[22] Filed: Jun. 6, 1979

[51] Int. Cl.[3] ..... B65B 57/00; B65B 7/20

[52] U.S. Cl. ..... 53/76; 53/77; 53/137; 53/374

[58] Field of Search ..... 53/76, 77, 137, 374

[56] References Cited

U.S. PATENT DOCUMENTS

| | | | |
|---|---|---|---|
| 3,045,402 | 7/1962 | Keely et al. | 53/374 X |
| 3,267,640 | 8/1966 | Romney et al. | 53/374 X |
| 3,905,175 | 9/1975 | Marchetti | 53/374 X |
| 4,079,577 | 3/1978 | Ulrich et al. | 53/374 |

*Primary Examiner*—Travis S. McGehee
*Attorney, Agent, or Firm*—Paul & Paul

[57] ABSTRACT

An apparatus for closing boxes comprising a conveyor for bringing a box in centralized position between two vertically arranged transport belts which can be moved toward each other to engage the side walls of the box the four top flaps of which are open, whereafter the said transport belts move the box to a bridge the height of which is adjustable and which is provided with a sensing member, which on the engagement thereof with the fore wall of the box when the bridge is in its lowest position operates means to cause raising of the said bridge until the said sensing member comes into engagement with the fore wall flap of the box, which flap is closed by further movement of the box, the bridge being provided with a pivotably mounted arm carrying a rotatable wing for closing the rear flap of the box, with fixed arms for raising the side flaps and with pivotable arms carrying closing members which can be moved downwardly at an oblique angle toward the center of the upper surface of the box for closing the side flaps.

13 Claims, 6 Drawing Figures

71
77
73
72
74
75
76a
76
P5
80
64
78
65
66
79
63
67
62
68
70

34
35
37
36
38
P3
38b
33
38a

APPARATUS FOR CLOSING BOXES

The invention relates to an apparatus for closing boxes comprising means for bringing a box between two vertically arranged transport belts which are moved to engage side walls of a box the four top flaps of which are open, and whereafter the said transport belts move the box centrally to a bridge the height of which is adjustable and which is provided with flap closing members and a sensing member, which said sensing member on the engagement thereof with a fore wall of the box when the bridge is in its lowest position operates means to cause raising of the said bridge until the said sensing member comes into engagement with a fore wall flap of the box, which said fore wall flap is closed by further movement of the box, and in which the bridge is provided with an arm for closing the side flaps thereafter.

Similar apparatus is known from Dutch patent application No. 67.07199, laid open to public inspection.

In this known arrangement, the bridge is provided with fixed members thereon for closing the side wall flaps of the box. These members have the form of bent rails and the foremost portions of which are bent downward and outward so that these will lie under the side flaps after the fore flap has been closed and the box is moved further forward. Due to the fact that the foremost portions of the rail-like members extend inward, the upper flaps of the box are closed thereby.

An important objection of this is that the rail-like members generally only lie against the trailing-edges of the side flaps, and only then when the width of the box lies within certain limits.

The force exercised on the leading-edges of the flaps must thus serve to close them and this can raise great objections hereto; for example when the contents of the box are somewhat flexible and must be pushed into the box a little by the flaps in such a case, the peripheral edges of the fore and rear flaps extend somewhat above the top surface of the box, and so that they come to lie somewhat above the folds of the side flaps and against these. Where these conditions exist, considerable force must be applied to a side flap to close this flap.

As has been already stated herein, the boxes for closing must have a certain width. With very small boxes for example, the free-ends of the foremost portions of the side flap closing members will lie under these flaps and especially when they hang outward and downward from the sides of the box.

The application possibilities of this known apparatus are thus very limited.

This objection has been removed in the present invention by the provision of an apparatus which is characterized in this, that the means for closing the side flaps of the box are formed by movable arms which are arranged on and extend downward at an angle from the bridge and which, together with the transport belts, are moved toward the box and lie directly above the transport belts when the bridge is at its lowest point and such that on a following upward movement of the bridge the side flaps of the box are brought into positions by the said movable arms in which the said side flaps are directed outward and upward at an angle, and in which the bridge further comprises members which come into operation after the closing of the fore and rear flaps of the box and which exercise such movements that they engage the side flaps substantially along the longitudinal edges thereof to push these longitudinal edges toward one another and toward the top surface of the box.

Whilst naturally the apparatus becomes complicated by the movable members, this is offset by the fact that no difficulties arise in closing the side flaps when the longitudinal edges of the fore and rear flaps protrude somewhat upward and where the closing force is exercised on a portion of the side flap which is as far away from the folding line as possible. Also in the case where only a slight closing force is required, a considerable closing force moment is thus already exercised on the flap.

Furthermore a good side flap closure is ensured with all widths of box.

The closing of the side flaps takes place immediately after closure of the fore flap which is effected by movement of the box under the sensing member of the bridge. This sensing member simultaneously energizes the members for closing the rear flap. Due to the fact that closure of the side flaps takes place independently of box length, it is possible to have a considerably shorter apparatus and a higher throughput speed for the boxed, and this jointly because the fore edges of the side flaps are not pushed up against fixed members.

To this end, the members pushing the side flaps into the closed position are formed by rods arranged approximately parallel to one another in the direction of movement of the boxes, each of which rods is affixed to a footpiece which is pivotably mounted on the end of an arm the other end of which is pivotably connected to the bridge, and in which means are provided between each of the footpieces and the relating arm, through which the footpieces and the relating arm, through which the footpieces and therethrough the closing members are moved substantially parallel to one another through the downward movement of the rods toward the center of the box, and which movement is obtained by the position adopted by the spindles on which the arms pivot and which position is at an angle to the vertical.

Just as in the known apparatus the pivotable arm, arranged on the bridge pieces for closing the rear flap of the box, is also pivotable in the horizontal plane from a stance, when the bridge-piece is in its lowest position, in which it lies out of the vertical plane of the transport belt present on the side thereto, to one in which a portion thereof lies against the rear wall of the box being fed for closure and which portion moves upward along the rear wall of the box as the bridge moves upward.

When in this case, the portion of the arm in engagement with the rear wall of the box reaches the top end of the rear wall of the box then the arm must swing over the upper side of the box to effect closure of the rear flap. The vertically upward movement of the bridge and thus also the arm, however, is controlled by the sensing member which lies against the fore side of the box so that when the height of the box near the front side is a little smaller than it is on the rear side, the bridge comes to rest at such a height that the arm will not be able to easily fold the rear flap down, whilst on the coming to rest of the bridge in its upward movement the box is directly brought into movement and away from the arm. There especially exists the danger here that, with a considerably high throughput speed, the rear flap will not be well closed. This situation can manifest itself when the contents of the box protrude a little more from the box at its rear side than they do from the fore side for example. Furthermore, and in order to effect closure of the rear flap, the whole mass of the arm must be brought into operation and with a speed that is greater than that of the forward movement of the box. In order to effect this movement of the arm in the said direction, a driving mechanism must be provided therefor which will require much power.

According to the invention these problems are also eliminated insofar that this portion of the arm, which comes to lie against the outer rear wall of the box to be closed, forms part of a wing-member which is pivotable in respect of the arm which is pivotable connected to the bridge about an axis lying in a horizontal plane and substantially parallel with the rear wall of the box when the wing-member is in its operative position, and which wing-member in this position is inclined at an angle downward toward the rear wall of the box and in which driving means are provided by which, after the bridge has reached its highest position, the wing-member is pivoted in such a manner that the portion thereof extending outward above the spindle of the wing closes the rear flap of the box.

The lower portion of the wing-member ensures thus that the rear flap is brought from a position in which it extends at an angle downward to a position in which it extends at an angle upwards and whereafter, when the bridge is in its highest position, the wing-member operates directly to effect closure of the rear flap of the box. Through this, it is only generally necessary to bring the mass of the wing-member into movement, and through which movement the original upper portion of the wing-member mainly engages the outermost edge of the rear flap for the closure thereof without any single difficulty arising thereover, nor when the contents of the box extend a little above the top thereof near the rear flap.

According to a preferred embodiment of the invention, the wing-member is mainly in the form of a flat plate which is arranged substantially parallel to the spindle on which it pivots and which at some distance below this spindle, when viewed in the condition in which the wing member lies against the rear wall of a box, shows a small bend such that the portion thereof inclined toward the box makes a smaller angle to the horizontal plane than the other portion thereof.

Through this arrangement it is ensured that the rear flap will in any case, even when it is strongly bent inward and downward toward the box, be directed upward at an angle by the wing-member on upward movement of the bridge. Furthermore the wing-member has no need to turn through a great angle to close the rear flap when the bridge has been raised.

In order to ensure that the pivoting of the wing-member can only take place when the lower edge thereof positively lies against the rear wall of abox and only when the bridge has been raised to its highest position, the wing-member is driven by a coupling which permits the wing-member to make a small free movement and such that when it comes into engagement with the rear wall of the box the wing-member is turned a little, and which turning movement provides a first signal for pivoting the wing-member to close the rear flap but which turning movement only occurs when a second signal is provided when the bridge has reached its highest position.

The sensing member provided on the bridge can be of such a design that after the bridge has reached the highest position in its upward movement and the box is beginning to move further the sending member can exercise a pivoting movement about an axis which is horizontally arranged parallel with the fore wall of the box, and through which pivoting movement the sensing member co-acts with a closing rail which is movable in the vertical direction with respect to the bridge, and which comes to rest on the fore flap of the box to close it.

In the known apparatus, however, the sensing member is formed by a roller which is affixed to a rail which, in turn, is affixed to the bridge. In large high-speed operating apparatus wherein it is thus desirable that the bridge moves quickly upward, it is extremely difficult to bring the bridge to a stop at such an instant that the closing rail lies at precisely the correct height.

In the construction according to the present invention, the weight of the rail can always be utilised to effect closure of the fore flap of the box.

By reducing the weight of the closing rail the construction may be such however, that the closing rail co-acts with regulating means connected to the bridge whereby the closing rail also comes to rest on the box with a certain force.

When pneumatic-hydraulic means are provided for effecting vertical displacement of the bridge, the control means therefor can be constituted by a slide-valve the members of which are displaced one with respect to the other by movement of the closing rail with respect to the bridge, and which said slide-valve is included in the control system lines of the pneumatic-hydraulic means.

Through the pivoting movement of the sensing member cooperating with the movement of the closing rail and the control means, a fast braking of the upward movement of the bridge can be obtained and also a vertical movement of the bridge is achieved when this is necessary for good closure of the box.

In the known apparatus, centering of the box is achieved by bringing the transport belts simultaneously into engagement with the box from each of the sides thereof. The centering of the box with respect to the bridge must take place within the apparatus itself, and means for achieving this must be present which check whether both the transport belts are lying in engagment with the box, and only after which can the bridge be permitted to move upward. Such an operating condition is naturally not in the interests of the operating speed of the apparatus.

According to the present invention, there is provided an apparatus which is characterized by the provision of means for centering a box fed thereto before it is fed between the transport belts, which means comprises a number of driven spindles arranged one after another and on which there are mounted roller-blocks from the outer peripheral surfaces of which other rollers of barrel-form extend for free rotation on spindles therefor, and which said barrel roller spindles are arranged in the first said rollers at right angles to the said driven spindles therefor and spaced at distances therefrom, and at least two pairs of arms arranged above the said driven spindles and pivotable in the horizontal plane about the axes of spindles particular thereto which are arranged near the sides of the box feeding means, and which said arms are coupled in pairs such that they simultaneously pivot inward or outward and for which spring means are provided to always urge the said arms to adopt their innermost positions in which they are directed to converge somewhat forward toward the bridge to close off the greater part of the passage therethrough for the box.

So a box fed to the apparatus is thus carried along by the roller-blocks which are carried on the driven shafts therefor, in the direction of the bridge. When the box is not completely centered, which is generally the case, it comes up against one of the arms with its foremost lying edges and through which this arm will attempt to pivot away, and which action, however, the spring means will attempt to counteract. By this a lateral force will be exercised on a side wall of the box, or the foremost edge thereof, such that the box is displaced to one side. This side displacement is effected quite easily since the box lie on the rollers which are freely rotatable on their spindles which are accommodated in the roller-blocks and which are disposed at right angles to the normal direction of movement. As soon as the box comes into engagement with the other arm with as much force as it engaged the first arm, both arms will pivot away to allow passage of the box therebetween. By arranging two pairs of arms, one pair after the other, there is a positive elimination of the possibility that, after passing the centering means, the box will still assume a somewhat out-of-center condition.

It will be clear that to avoid too great a friction between the arms and the box, the foremost extremities of the arms can be provided with rollers or the like. By the fact that a box now is centrally fed to the transport belts, a contact member can be provided behind a somewhat flexible portion of one belt which is operative to ensure that the transport belts come into engagement with the box with a predetermined force.

Through this arrangement, the transport belts can be used directly to effect forward movement of the box without the necessity of being provided with catches by which the box is carried along and such as is the case in the known apparatus. By the use of such box engaging catches the transport belts must always be moved a certain distance before such catches can come into engagement with a box. This condition is particularly valid when short boxes are transported through the apparatus because the catches must be arranged at such a distance from one another that the longest of the boxes to be transported can be accommodated therebetween. It will thus be understood that, in principle, the throughput time for a box in closing apparatus of the known type will be no shorter with a smaller length of box, which implies that the useful output of such a transport means provided before the box closing apparatus becomes smaller with a decrease in box length.

In the apparatus according to the present invention on the other hand, a box is directly transported by the transport belts as soon as the transport belts are pushed into engagement therewith such that the box is pushed into engagement with the sensing member on the bridge. Through feeding of a centralized box between the transport belts, a predetermined adjustment of the contact member arranged behind one of the transport belts is possible so that further lateral movement inward of these transport belts is prevented when they have engaged the box with a certain force. This is not possible with the known apparatus wherein the boxes are centralized by transport rails, and wherein thus one rail must always care for the lateral displacement of a box until it also lies in contact with the other rail. The forward transport of a box takes place thereafter by means of transport belts arranged on the transport rails, and which transport belts are provided with the foregoingly quoted catches. Through this, and adjustable force for engagement of the boxes by the transport belts cannot be realized. Further, it is clear that in the forward displacement of a box frictional forces will be exercised thereon by the transport rails pressed against the boxes. The driving capacity required for the transport belts must then be greater than with the apparatus according to the present invention.

Just as with the known apparatus, the closed flaps of a box can be sealed with the aid of a strip of adhesive tape drawn off a supply roll thereof. In many instances it is time saving, when such a strip of adhesive tape is not only applied to the upper flaps which have just been closed, but also to the lower flaps which have not yet been already necessarily sealed due to the fact that, during the filling and closing process of the box, they are still supported by the transporting means such as conveyor belts, roller conveyors etc.

When the adhesive tape breaks, or the supply roll thereof is empty, the flaps of the box are not sealed. When this happens in the case of the lower ones of the flaps this is dangerous for the contents of the box; such an occurrence in the case of the upper flaps is also a big disadvantage insofar that these flaps, which have just been closed by the apparatus, will again spring open and through which the work down by the apparatus will be nullified to a great extent.

In order to eliminate this disadvantage there are now provided, in accordance with the present invention, means for checking whether an adhesive tape strip has been applied to the box and for stopping the closing apparatus and forward movement of a box present in the tape application section, when no adhesive tape is applied.

It will be clear that when a strip of adhesive tape is applied to the bottom of a box as well as the top, stopping of the apparatus will take place as soon as no adhesive tape has been applied to the top or the bottom of the box.

According to a preferred embodiment of the invention, the checking means is constituted by a feeler which is arranged in the path of the adhesive tape between the supply roll and the free end thereof which has been affixed to a box, and such that in the presence of adhesive tape the feeler is somewhat displaced thereby to cooperate with switching means by which the apparatus is maintained in operation.

In this case the switching means cooperating with the feeler can be activated with the aid of the pivoting movement of a carrier to which the free end of the adhesive tape is affixed, and which pivoting movement is originated by an oncoming box engaging the adhesive side of the tape which is then moved with the box and is withdrawn from the supply roll thereof.

Through the tension developed in the adhesive tape by the force exercised thereon as it is pulled from the supply roll, the adhesive tape comes into engagement with the feeler and the feeler is displaced in such a manner that the apparatus is maintained in operation. If the adhesive tape now breaks, or the supply thereof from the roll runs out, the tension in the adhesive tape will fall away with the result that the feeler will no longer be held in its active position and will effect switching-off of the apparatus. When a box has had the adhesive tape applied thereto in the correct manner and the taping process therefor is completed, the foregoingly quoted carrier is released and thereafter first takes care that the feeler is rendered non-operative before the adhesive tape is severed and the tension therein falls away.

The invention is now further to be described with reference to the accompanying drawings which show an example of an embodiment and in which.

Figure 1:
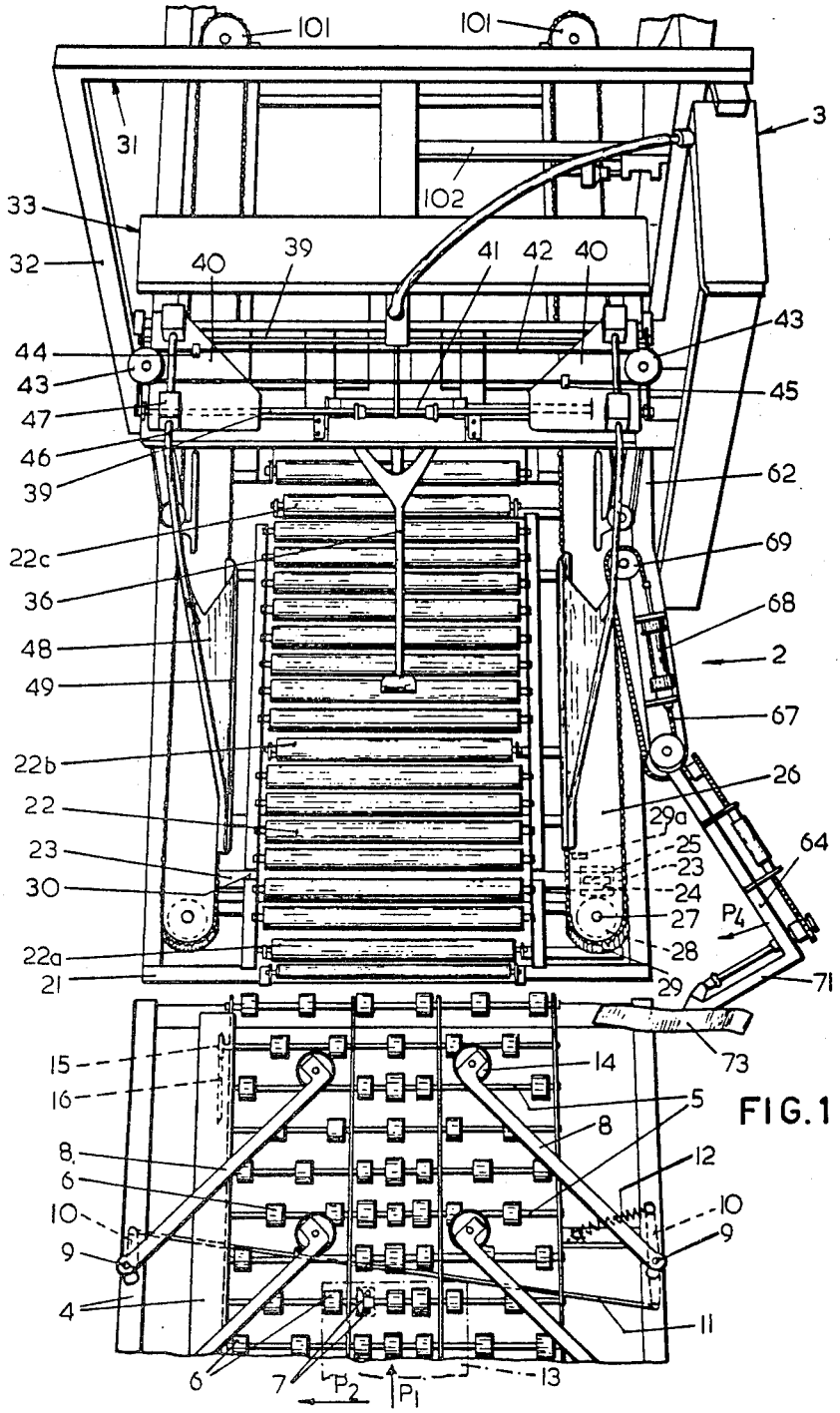
FIG. 1 shows schematically, in plan view perspective, a box closing apparatus according to the invention in its non-operative condition.

As particularly shown in FIG. 1, the apparatus comprises a box centering and transporting section generally indicated by the reference numeral 1, a box closing section 2, and a box sealing section 3.

Section 1 of the apparatus comprises a frame 4 which serves to support the spindles 5 on which rollers 6 are accomodated such that a box fed thereto can be transported thereby in the direction indicated by the arrow P1. The rollers 6 also accomodate rollers of barrel form 7 therein the axes of which are disposed at right angles to the axes of the spindles 5. This arrangement makes it possible for a box, fed over the rolls 6, also to be moved easily in the direction indicated by the arrow P2.

The frame 4 further accomodates 2 pairs of pivotable arms 8 mounted therein. Each of the arms 8 is carried by a spindle 9 in fixed relationship therewith, whilst each of the spindles 9 is fixed to a lever arm 10. A coupling rod 11 is pivotably mounted to the extremities of the lever arm 10 so that the arms 8 can exercise pivoting motions which are symmetrical in relation to the centerline of the apparatus as a whole. One of the spindles 9 is provided with a lever arm 10 the other end of which is attached to a tension spring 12 the other end of which is fixed to the frame 4, and in such a manner that the arms 8 are urged to take up their innermost positions.

When a box 13 the foremost part of which is depicted with chain-dotted lines, is fed over the rollers 6 until it glidingly engages the first arm 8 it will follow an angular path along the arm 8 since it can easily move to the left over the rollers 7 of barrel-form. Only when both vertical leading faces of the box 13 engage against both arms 8, will these arms be pushed outward against the action of the tension spring 12 and whereafter the box will pass between the two arms. In order to facilitate this passage the ends of the arms 8 can be provided with rollers 14. When the box comes up to the second pair of arms 8, the foregoingly described procedure is repeated such that the box comes into section 2 of the apparatus centered-up as good as possible.

To this end the rollers 6 are driven via the spindles 5 which are provided with sprocket-wheels 15 engaged by the chain 16. One of the spindles 5 is driven by an electric motor or the chain 16 runs over a sprocket wheel provided to the shaft of the motor.

Section 2 of the apparatus comprises a frame 21 in which transporting rollers 22 of a conveyor are supported for rotation therein. Rollers 22*a*, 22*b* and 22*c* can exercise the functions of switch operating rollers. To this end they can be mounted in such a manner that they are spring urged vertically upward so as to extend above the surface of the other rollers. When a particular roller is forced downwards by a box passing thereover a switch is operated.

Figure 2:
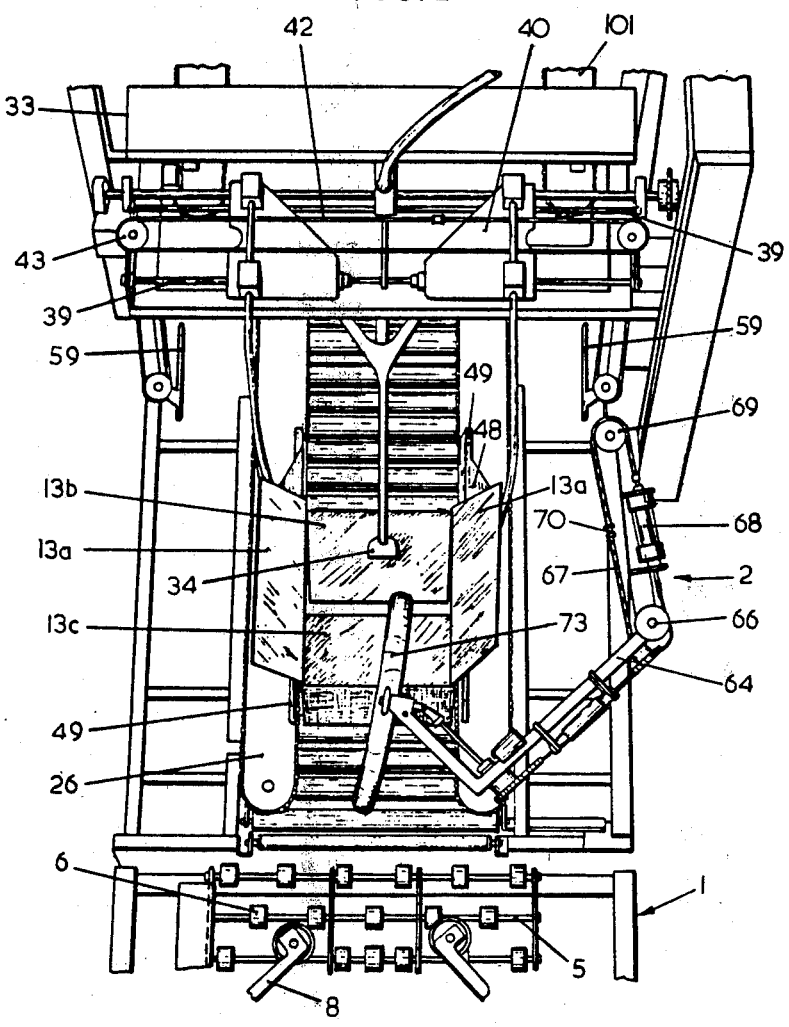
FIG. 2 shows a view of a part of the apparatus shown in FIG. 1, but with various integers thereof in the operative condition, and wherein there is shown a box for closing accomodated in the apparatus.

Below the rollers 22 and the parts of the frame serving to support these rollers guide rods 23 are arranged in the frame 21. These guide-rods 23 are provided with bushes 24 thereon, and which bushes 24 are in turn affixed to plates 25 which are, again in turn, affixed to transport belt supporting members 26. The transport belt supporting members extend in the longitudinal direction of the frame 21 on both sides thereof. The supporting members 26 carry spindles 27 accomodating rollers 28 thereon, over which transport belts 29 run. The transport belts 29 can be displaced laterally, from the positions in which they are in the position of rest as depicted in FIG. 1, inwardly to a position in which they come into engagement with a box as shown in FIG. 2, this lateral positioning is achieved by means of the bushes 24 and the guide rods 23. During this the plates 25, connecting the bushes 24 with the supporting members 26, can move between certain ones of the rollers 22, as indicated by the reference numeral 30 for example, and at which position parts of the frame supporting the rollers 22 are shown broken away. The displacement of the transport belts is effected by means of a pneumatically-operated cylinder which is operatively coupled to one of the bushes 24 or to one of the plates 25 for example. In order to ensure that the transport belts 29 move simultaneously inward over the same distances, they can be coupled at their fore and rear ends by chains which extend laterally therebetween and which engage sprocket wheels which are rotatably accomodated at fixed positions on the frame. Each of the two parallel running parts of the chain is coupled to one of the bushes 24 so that, on displacement of one bush over a certain distance inwards, the corresponding bush exercises a movement over the same distance. Such a system is further to be described herein, because this system is adapted to other parts of the apparatus. Such a chain is provided for the fore end of the transport belts 29 as well as the rear end and for parallel guidance thereof, for example one sprocket wheel of the forward part can be coupled to the sprocket wheel of the rearward part of the transport belts 29. Alternatively, use can be made of a single chain which operatively engages with a number of supplementary sprocket wheels.

Section 2 of the apparatus further comprises a portal 31 the vertical columns 32 of which serve to guide the vertical movements of the bridge 33 upward and downward. To this end, the bridge can be supported by ball bearing bushes which run on a hardened shaft, but naturally rack-and-pinion devices can be employed as will be evident to the expert. The upward and downward movements of the bridge can be effected by means of hydraulic-pneumatic cylinders.

Figures 4, 5:
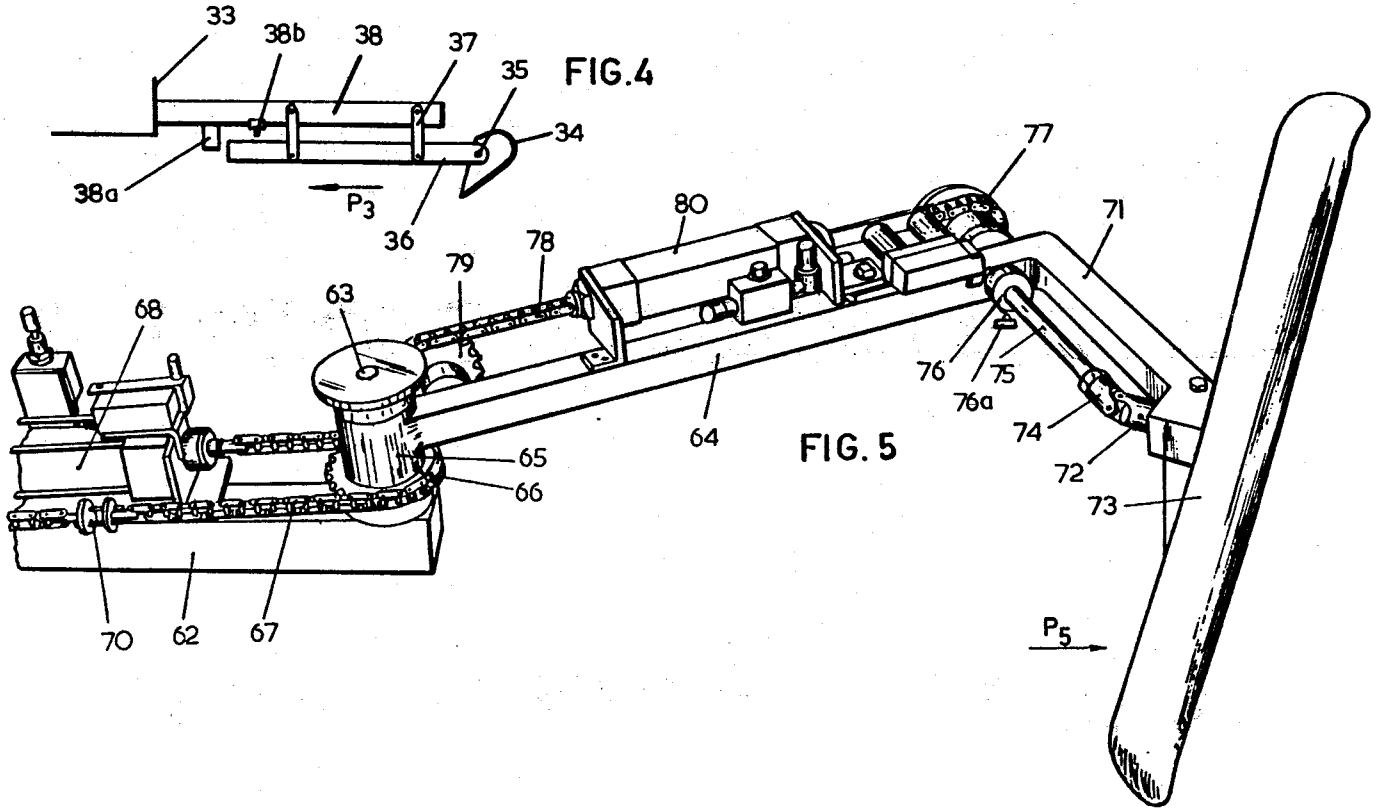
FIG. 4 shows a schematic side elevation of a part of the apparatus which is first engaged by the front of a box when the latter is fed thereto.
FIG. 5 shows a perspective view of a part of the apparatus serving to close the rear flap of a box fed thereto.

As schematically shown in FIG. 4, the bridge 33 is provided with a sensing member 34 which is movable affixed thereto. This sensing member 34 is pivotably mounted on an arm 36 via a spindle 35, which arm 36 is coupled, via two pivotable connecting members 37, to a carrier 38 which is in turn carried by the bridge 33 in fixed relationship therewith. In its unloaded condition, the arm 36 will substantially assume the position in which it is shown in FIG. 4 by its own weight.

Further, two guide rods 39 are arranged on the bridge 33, and on which guide rods 39 two support plates 40 are slidably accomodated. An operating cylinder 41 is mounted in operative relationship to one of the support plates 40, whilst displacement of the support plates is synchronised by means of a chain 42 which engages sprocket wheels 43 which are supported for rotation at fixed points on the bridge 33. At one point along its length, the chain 42 is affixed to one of the support plates 40 at the point designated by the reference numeral 44, whilst at another point along its length the chain 42 is affixed to the other one of the support plates 40 at the point designated 45. When a force is exercised by the cylinder 41 in the leftward direction on the righthand one of the support plates 40, the chain transmits a like movement to the other support plate 40 but in a direction opposite to that of the righthand support plate 40, and through which movements of both the support plates 40 they will move toward each other or away from each other. Naturally the ends of the chain can be conneced to each other by means of a chain tensioner which is not shown.

A staff-like arm 46 is affixed to each one of the support plates 40 and by means of, for example, block-like members 47, through which the position of the arms 46 can be set and locked against movement therefrom. These arms 46 are provided with triangular plates 48 on the free ends thereof and the under edges 49 of which lie somewhat above the corresponding transport belt 29 when the apparatus is in the rest condition.

Figure 3:
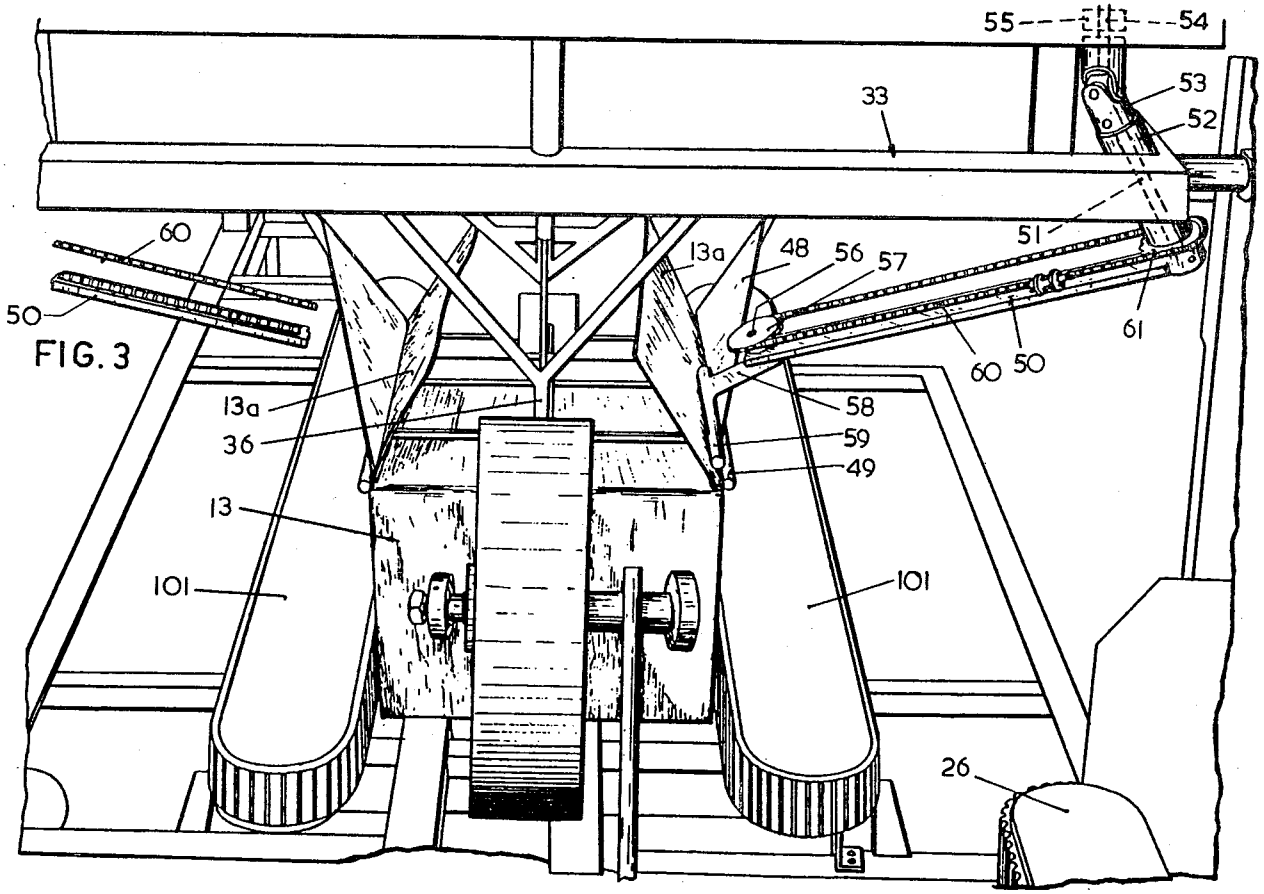
FIG. 3 shows a perspective view of the discharge end of the apparatus shown in FIGS. 1 and 2.

As particularly appearing in FIG. 3, yet two further pivotable arms 50 are arranged on the bridge 33. Each of these arms 50 is affixed to a spindle 51 which is rotatably supported in a bush 52 affixed to the bridge 33. Each of the other extremities of the spindles 51 has a universal joint 53 affixed thereto, and to the other end of which universal joint 53 a vertically running shaft 54 is affixed and rotatably supported in a bearing bush 55 which is also affixed to the bridge 33. Each of the two shafts 54 can be provided with an arm (not shown), and which arms are arranged in opposition to one another and joined by a coupling rod which can be displaced by means of a pneumatically operated cylinder for example.

Through operation of this cylinder, both the arms can be simultaneously moved inward toward each other or outwards away from each other.

A spindle 56 is rotatably mounted on the free end of each of the pivotable arms 50, and each of these spindles carries a sprocket wheel 57 on one end and a footpiece 58 which carries a closing member 59. A chain 60 engages each one of the sprocket wheels 57 and further engages another sprocket wheel 61 which is affixed to the bush 52. The chain 60 and the sprocket wheels 57 and 61 ensure that, during the pivoting movements of the arms 50, the closing members 59 move in such a manner that the longitudinal axes thereof still move parallel to the longitudinal axis of the closing apparatus. Naturally the chain can be provided with a not shown tensioning device. It will also be clear that the chain 60 and sprocket wheels 57 and 61 can be replaced by a system of levers with a coupling rod therebetween.

As shown in FIG. 1, yet another carrier 62 is arranged on the bridge 33. As particularly appearing from FIG. 5 a spindle 63 is arranged on the free end of the carrier 62 and on which an arm 64 is pivotably mounted by means of a bush 65. The bush 65 is affixed to a sprocket wheel 66 which can be turned by means of the chain 67 and the pneumatically operated cylinder 68. As appearing from FIG. 2, the chain also engages a sprocket wheel 69, and a chain tensioning device 70 is included in the chain.

The arm 64 is provided with a portion 71 which is bent substantially at a right angle to the rest. A spindle 72 is rotatably supported in the portion 71. The spindle 72 carries a closing wing 73 on one side and is connected on the other side to a spindle 75 by an universal joint 74, the spindle 75 being rotatably supported in the arm 64. The spindle 75 is connected to the sprocket wheel 77 via a schematically shown coupling 76 which permits a degree of free movement between the sprocket wheel 77 and the spindle 75 itself and the sprocket wheel 77 is engaged by a chain 78 which also engages the sprocket wheel 79 and which can be moved by means of the pneumatically operated cylinder 80.

The operation of the foregoingly described apparatus is as follows:

A box 13, of which the upper flaps thereof extend outward in the open condition, is by means of the section 1 centralized fed on to the section 2.

As soon as the box 13 engages with the switch operating roller **22*a* (FIG. 1) a switch is operated which brings a pneumatically operated cylinder into service and through which the supports 26 of the transport belts are caused to move toward each other at the same rate. This movement continues until the box operates a switch 29*a* which is arranged behind one of the transport belts 29 such that it pushes the belt somewhat outward toward the box. Through the operation of this switch, compressed air at a regulated reduced pressure is fed to the pneumatically operated cylinder and through this the transport belts 29 are held against the box 13 with the desired amount of pressure. The transport belts 29 carry the box 13 forward with them because at the same time as the cylinder is operated to bring the transport belts together, the transport belts are set into motion by motors (not shown) which drive the rear shafts 27 of the rollers 28. In general, the transport belts 29** will be rubber belts provided with a series of vertically arranged ribs which will effect positive carrying of the box with them.

The foregoingly quoted switch **29*a* also serves a pneumatically operated cylinder (not shown) which moves the support plates 40, arranged on the bridge 33, toward one another and in such a manner that the arms 46 arranged thereon, together with the plates 48, are brought to the box. This cylinder is operatively supplied with air at a reduced pressure, and such that when the plates 48** come into contact with the box they will not buckle the box in, but will continue to remain pushing against it with a light force.

On further carrying forward of the box by means of the transport belts 29, the box will come into engagement with the sensing member 34 which will then be displaced in the direction of the arrow (see FIG. 4). Through the displacement of the arm 36 in relation to the carrier 38, a switch **38*a* thereon is operated. This causes movement of the transport belts 29 to cease, and whereupon the cylinder operative to effect vertical upward movement of the bridge 33 is activated. Through this movement the plates 48 are carried upward with it along the sides of the box and such that the side flaps 13*a* thereof are brought up to asume a vertical position at an angle thereto as shown in FIG. 2**.

During the upward movement of the bridge 33 the sensing member 34 takes care for it that the front plate 13*b* of the box 13 is pivoted upwardly.

As soon as the sensing member 34 has reached the upper edge of the fixed front surface of the box 13, the sensing member with the arm 36 will move somewhat back in the direction opposite to the arrow P3, mainly in consequence of its weight, by which movement the switch 38*a* is operated again and the transport belts are put into operation again to push the box 13 through under the arm 36 and the bridge 33. During this movement the front flap 13*b* of the box 13 is pushed downward onto the box as indicated in FIG. 2.

When the box 13 has passed over the switching operating roller 22*a* and the fore side of the box comes up against switch operating roller 22*b*, both the switches operated by these rollers effect feeding of compressed air to the cylinder which operates to impart movement to the chain 67 accommodated on the carrier 62. By this the arm 64 is pivoted in the direction indicated by the arrow P4 (see FIG. 1) until the lower part of the closing wing 73 comes to lie against the rear wall of the box 13.

This can occur before the bridge 33 is raised, and during raising of the bridge 33 the lower part of the closing wing 73 will lift the rear flap 13*c* of the box 13 so that it will extend upward at an angle from the box.

With a length of box greater than that for which the apparatus has been designed, the bridge 33 can already be raised before the lower part of the closing wing 73 pivots toward the rear wall. The rear flap must then be in such a position that it cannot be pushed against the rear wall of the box by the closing wing.

When the lower end of the closing wing 73 comes to lie against the rear wall of the box 13, a certain force will be exercised on the closing wing and in the direction indicated by the arrow P5 as shown in FIG. 5. Through the presence of the coupling 76, allowing a degree of free movement, the closing wing 73 can pivot somewhat leftward and this leftward movement effects operation of a switch 76*a* arranged in a position near the coupling. The angle through which the closing wing 73 pivots is only small so that it, in the manner previously described, lifts the rear flap 13*c* of the box 13 up. The switch 76*a* signals, however, that the closing wing lies against the box, and when the sensing member 34 now emerges out from over the box in the manner previously described and through which the arm 36 reverts back to its original position, another switch is operated which effects the supply of compressed air to the cylinder 80 which, in turn, effects movement of the chain 78 and through which the closing wing 73 will be pivoted leftward as shown in FIG. 5. The closing wing 73 then assumes the position as shown in FIG. 2, and in its movement closes the rear flap 13*c* of the box. This movement takes place rapidly since the rear flap must be closed before the box has proceeded too far under the sensing member 34 otherwise the rear flap 13*c* would engage this sensing member.

Through further forward movement of the box 13, the fore edge of the rear flap 13*c* of the box 13 comes to lie under the sensing member 34 as well, so that both the front and rear flaps are held closed. The fore edge of the box 13 now comes onto the switch operating roller 22*c*, and the switch operated thereby effects feeding of compressed air to the cylinder driving the spindles 54. Turning movements of these spindles cause the pivotable arms 50 to pivot inwards and the closing members 59 thereof come up against the side flaps 13*a* of the box 13 and push these down onto the front and rear flaps. Since these side flaps 13*a* are already directed upward at an angle, positive engagement between these flaps and the closing members 59 will always take place whilst these members, in their final positions, will come to lie at a fair distance from the lines defining the joints between the flaps and box, and such that they can exercise a considerable closing force on the side flaps to bring these into the totally closed positions.

It will be clear that before the described movements of the closing members 59 can take place, the closing wing 73 must already have reverted to its initial position, whilst the arm 36 and the carrier 38 are designed to be so small in size that they can move between the pushed-down side flaps until the sensing member 34 is completely free of the box.

When the now closed box has passed completely under the bridge 33 a signal is given by another switch operating roller (not shown) that the bridge 33 can again move downward, and that all operative parts can revert to their initial positions as shown in FIG. 1.

The cycle can then be repeated again.

It should be noted that when the box 13 shifts through under the arm 36, another switch 38*b* operates to bring the arm 36 to rest on the box with a relatively small preset force and so as to hold the front flap closed, whilst there is no resting of the entire weight of the bridge 33 on the box. Should this last mentioned condition indeed occur, then the switch 38*a* is closed and the bridge is raised further. The bridge is brought into an operatively balanced condition by the switch 38*b*.

Before the closed box has passed completely through under the bridge 33, the leading edge of the box 13 comes into the foregoingly described box sealing section 3 of the apparatus and as illustrated in FIG. 1.

This section 3 comprises two, schematically illustrated, transport belts 101, which are operative to bring them toward each other, in the manner previously described with reference to transport belts 29, to further transport therebetween a box which has been fed to them. The supporting of the transport belts 101, the displacement toward each other, the means of driving and setting into operation is achieved in manners corresponding to those described foregoingly herein for the transport belts 29, and thus need not be detailed further. There is also provided another bridge 102 which normally rests in the lower position, and which is raised when the fore side of the box 13 comes into engagement with the sensing member which causes the bridge 102 to be raised to a certain height with respect to the box which is fed to it.

Figure 6:
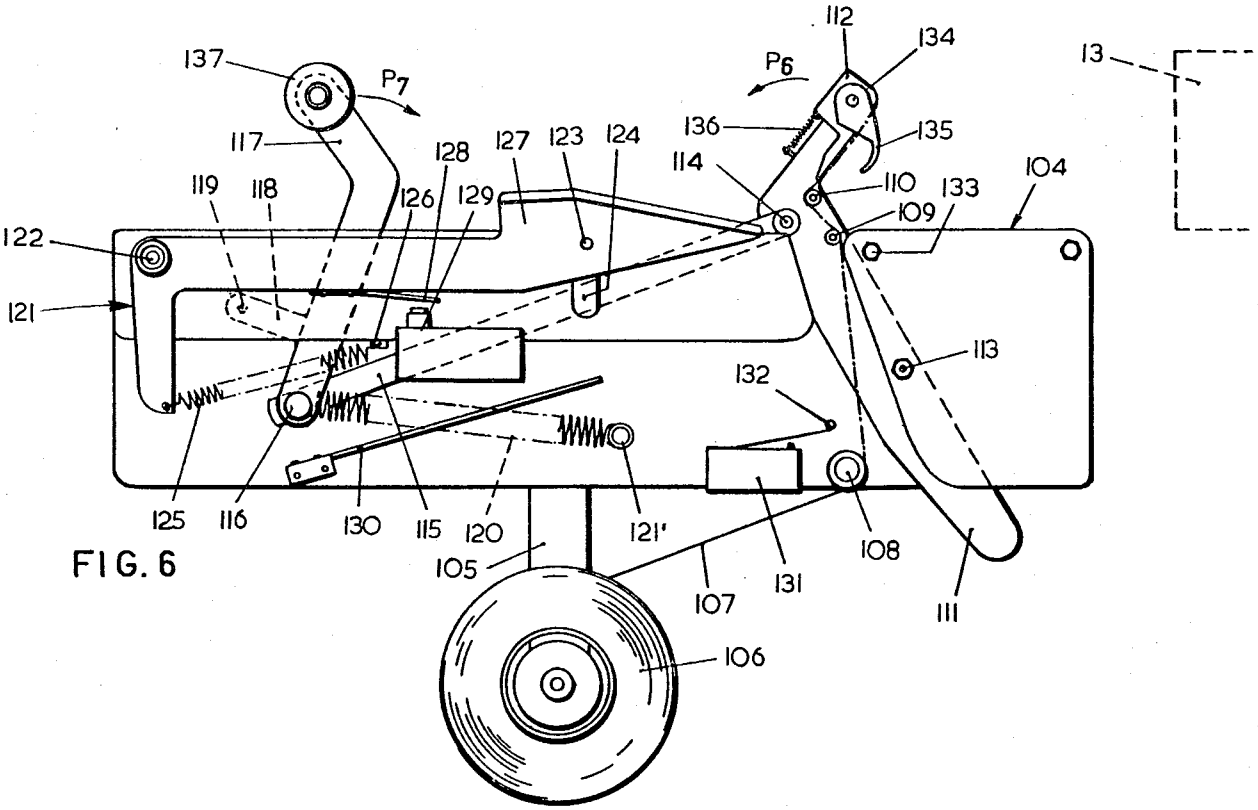
FIG. 6 shows a schematic side elevation of an apparatus in which adhesive tape can be applied to a closed box.

The bridge 102 is provided with apparatus 103 for the application of a sealing strip of adhesive tape, similar apparatus is also provided and located in a position under the box such that the lower flaps are sealed simultaneously with the sealing of the upper flaps as the box passes, through section 3 of the apparatus. The lower sealing strip application apparatus is illustrated in FIG. 6 and it will be clear that such apparatus, but in a vertically reversed position, is affixed to the bridge 102 and which, when the bridge has been raised, lies above the box to the greater extent.

The sealing strip application apparatus 103 comprises mainly a plate-like frame 104 with an arm 105 extending therefrom, which supports a supply roll 106 of adhesive tape 107.

The adhesive tape 107 runs from the supply roll 106, via a guide roll 108 rotatably mounted in a fixed place on the frame 104, and the two guide rolls 109 and 110 rotatably mounted on a pivotable arm 111, to a take-up member 112 likewise mounted on the pivotable arm 111 and on which the end of the adhesive tape lies. The last part of the passage of the adhesive tape is shown as a dotted line for the purpose of clarification.

The pivotable arm 111 is pivotably arranged on a spindle 113 which extends between parts of the frame 104. A rod 115 is connected to the pivotable arm 111 at the point of pivoting 114 thereof. The other end of the rod 115 is connected to an arm 117 at the point of pivoting 116 thereof of the arm 117 is provided with a cross arm 118 extending therefrom and the end of which is pivotably mounted in the frame 104 at the pivot point 119 thereof. A tension spring 120 is attached to the pivot point 116 and the other end of this tension spring 116 is affixed to the frame 104 at a point 121' thereon. In addition to this an angular lever 121 is rotatably mounted in the frame 104 at the point 122 thereof. A pin 123, extending from the angular lever 121 runningly engages in a slot 124 in the frame 104, through which movement of the angular lever 121 is limited. One extremity of the angular lever 121 is subjected to the influence of the tension spring 125, whilst the other end of the tension spring 125 is affixed to the frame 104 at a fixed point 126 thereon. The angular lever 121 is provided with a wedge portion 127. To the underside of the angular lever 121 a leaf spring 128 is affixed, which serves to operate a micro switch 129.

Yet another leaf spring 130 is affixed to the frame 104, the function of which is to be further described later herein. In addition hereto yet another micro switch 131 is arranged on the frame 104, and of which the switching roller 132 cooperates with the adhesive tape 107.

A stop pin 133 is further affixed to the frame 104, the purpose of which pin is to limit the angular amount through which the arm 111 pivots and the adhesive tape cutting member 135 is pivotably mounted on a spindle 134 extending from the pivotable arm 111, and this cutting member 135 is pulled to its terminal position by means of a tension spring 136.

The operation of the device is as follows:

When a box 13, indicated by the chain lines in FIG. 6 is fed from the right by means of the transport belts 101 and supported by the transport rollers (not shown) of section 3 of the apparatus as a whole, the fore wall of the box 13 comes into engagement with the memnber 135, which then pivots about its pivot point 134, and into contact with the end of the adhesive tape 107 which is located on the take-up member 112. Because the adhesive side of the tape is directed toward the box 13 the tape will be pushed onto the fore side of the box to which it will adhere. Meanwhile, the pivotable arm 111 pivots about point 113 and in the direction indicated by the arrow P6. The rod 115 ensures that, for this movement, the arm 117 is pivoted rightward and in the direction of the arrow P7. When the underside of the box 13 has pivoted the arm 111 so far letward that the box 13 moves over the integers 112 and 135 of the arm the roller 137, located at the end of the arm 117, will also come to lie under the bottom of the oncoming box 13. Over the last part of the pivoting movement of the arms 111 and 117, the rod 115 comes to lie against the leaf spring 120 which ensures that such a sufficient force is applied to said arms that they are returned to their initial positions, because in the final position, the spring 120 only exercises a slight returning force in view of the fact that in this position the spring 120 lies nearly parallel to the rod 115.

Through pivoting of the arm 111, that portion of the adhesive tape between rollers 108 and 109 will come into engagement with the roller 132 of the switch 131 so that this switch, which is wired in a parallel circuit, will be closed. On further shifting up of the box, it presses the wedge portion 127 of the angular lever downward and through which the switch 129 is operated via the leaf spring 128. The switch 129 is included in the main circuit and is opened so that the apparatus remains in operation since current can flow through switch 131.

Whenever the adhesive tape 107 breaks or the supply roll 106 is empty, the adhesive tape 107 will no longer exercise pressure on the roller 132 of the switch 131, the switch will open and through which the parallel circuit is broken, whereupon the apparatus is deprived of power and comes to a standstill.

It will be obvious that the switches 129 and 131, of the adhesive tape application apparatus located above the box 13, are connected in series with the corresponding switches of the adhesive tape application apparatus located under the box, so that the apparatus, as a whole, will be brought to a standstill should the adhesive tape in one or the other of the application arrangements break of the supply there of runs out. Through these arrangements protection is obtained against non-application of adhesive tape to a box, and so that it is no longer possible for a box to leave the apparatus without being sealed.

When a box 13 is completely pushed through and the arms 111 can again return, time delay arrangements ensure that switch 131 does not directly break the parallel circuit, but that first the switch 129 for the main circuit can close through the return also of the angular lever 121 to its original position, and through the passing of the box 13 of the wedge portion 127. When, due to one or another reason, the wedge portion 127 remains where it is, for example through the fact that no discharge of boxes is able to take place, the whole apparatus will be brought to a standstill. Through return movement of the angular lever 111 to its original position, the cutting member 135 can also return to its original position whereby the adhesive tape 107 is severed, whilst through springing back of the arm 117, the roller 137 will move up along the rear wall of the box 13 to firmly press the severed free end of the adhesive tape against the box.

It will be readily understood that only one of the possible embodiments of the apparatus has been described and that many modifications can be made hereto without going outside of the scope of the invention.

We claim:

1. An apparatus for closing the four top flaps of a box comprising:

two transport belts, said belts being movable into engagement with the side walls of said box;

a bridge positioned above said transport belts, said bridge being movable to varying height positions;

means for bringing said box, the four top flaps of which are open, between said transport belts;

sensing means extending from said bridge, said sensing means engaging the fore wall of said box when said bridge is in its lowest position;

means responsive to said sensing means for raising said bridge and operating said transport belt for moving said box towards said bridge, said sensing means being raised thereby above said fore wall, the fore wall flap being closed by engagement with said sensing means as said box is moved thereunder;

means responsive to said sensing means for closing the rear wall flap concurrently with said fore wall flap closure;

means for folding the side wall flaps, said folding means extending downwardly at an angle from said bridge to present a surface which closes in on said side wall flaps as said bridge and said flaps are raised; and means closing said side wall flaps by engagement along the longitudinal edges thereof, said side wall flaps closing means responsively operating after said fore and rear flap closures.

2. An apparatus according to claim 1 wherein said sidewall flaps closing means includes a pair of closure mechanisms each having a rod arranged approximately parallel to the direction of movement of said boxes; a footpiece attached to said rod; an arm in pivotal connection with said footpiece on one end, the other end of which is pivotably connected to said bridge; and means associated with said footpiece and said arm for moving each said closure mechanism substantially parallel to one another through a downward movement of said rods toward the center of said box, which movement is obtained by the position adopted by said arm pivotal connection, which position is at an angle to the vertical.

3. An apparatus according to claim 1 or 2 wherein said rear wall flap closing means includes a pivotable arm extending from said bridge being pivotable in the horizontal plane; a wing member which is pivotable in respect to said arm is pivotable about an axis lying in a horizontal plane and substantially parallel with said rear wall of said box, said wing member being inclinable at an angle downwardly toward said rear wall of said box; and driving means responsive to said bridge position for pivoting said wing member for closing said rear flap of said box.

4. An apparatus according to claim 3 wherein said rear flap closing means pivotable arm also includes a spindle, and wherein said wing member is mainly a flat plate substantially parallel to said spindle on which it is positioned to pivot which, when said wing member is below said spindle and against said rear wall of said box the portion thereof inclined toward said box makes a smaller angle to the horizontal plane than the other portion thereof.

5. An apparatus according to claim 4 wherein said wing member driving means includes a coupling which permits said wing member to make a small free movement when engaged with said rear wall of said box to turn a little, a first signal means initiated upon said turning for directing said driving means for causing said wing member to close said rear flap, and a second signal means for locking out said first signal directing when said bridge is not in its highest position.

6. An apparatus according to claim 1 wherein said sensing means includes a closing rail selectively vertically movable with respect to said bridge and a sensing member selectively pivotable with respect to said closing rail, wherein after said bridge has reached the highest position said sensing member can exercise a pivoting movement about an axis through which said sensing member co-acts with said closing rail which can move in the vertical direction with respect to the bridge permitting said sensing member to rest on the fore flap of said box closing it.

7. An apparatus according to claim 6 also including a regulating means connected to the bridge for causing said closing rail also to come to rest on said box fore flap with a certain force.

8. An apparatus according to claim 7 also including pneumatic-hydraulic means for effecting vertical displacement of said bridge, the control therefor including a slide-valve, members of which are displaced one with respect to the other by movement of said closing rail with respect to said bridge which slide-valve is included in control system lines of said pneumatic-hydraulic means.

9. An apparatus according to claim 1 also including means for centering said box between said transport belts, which means comprises a number of driven spindles arranged one after another and on which there are mounted roller-blocks, a number of free rollers positioned adjacent to said driven roller blocks in free rotation on spindles there apart of, at least two pairs of arms arranged above said driven spindles said arms being connectively coupled in pairs such that they simultaneously pivot inward or outward, and spring means for urging said arms to adopt their innermost positions in which they are directed to converge somewhat toward said bridge closing off the greater part of the passage therethrough for said box.

10. An apparatus according to claim 9 also including a contact member positioned behind one of said transport belts and being operative to ensure that said transport belts engage said box with a predetermined force.

11. An apparatus according to claim 1 also including a strip of adhesive tape drawn off a supply roll thereof, and means for checking whether said adhesive tape strip has been applied to said box for stopping the apparatus and movement of said box when no adhesive tape is applied.

12. An apparatus according to claim 11 wherein said checking means includes a feeler in the path of said adhesive tape between said supply roll and the free end thereof, such that in the presence of said adhesive tape said feeler is somewhat displaced thereby and a switching means responsive to said feeler for maintaining operation in the presence of said adhesive tape.

13. An apparatus according to claim 12 also including a carrier to which said free end of said adhesive tape is affixed, said carrier being capable of pivoting movement originated by a said oncoming box engaging said adhesive tape which is then moved with said box and is withdrawn from the supply roll thereof, said carrier cooperating with said feeler and said switching means.

* * * * *